US011149766B2

(12) United States Patent
Dalmas, II et al.

(10) Patent No.: US 11,149,766 B2
(45) Date of Patent: Oct. 19, 2021

(54) CONTROLLED TURBULENCE SYSTEM

(71) Applicant: Quest Engines, LLC, Coopersburg, PA (US)

(72) Inventors: Elario Dino Dalmas, II, Macungie, PA (US); Brett James Leathers, Allentown, PA (US); Douglas Charles Shoenberger, Coopersburg, PA (US)

(73) Assignee: QUEST ENGINES, LLC

( * ) Notice: Subject to any disclaimer, the term of this patent is extended or adjusted under 35 U.S.C. 154(b) by 110 days.

(21) Appl. No.: 16/546,642

(22) Filed: Aug. 21, 2019

(65) Prior Publication Data

US 2020/0063765 A1 Feb. 27, 2020

Related U.S. Application Data

(60) Provisional application No. 62/722,333, filed on Aug. 24, 2018.

(51) Int. Cl.
*F15D 1/12* (2006.01)
*F15D 1/00* (2006.01)

(52) U.S. Cl.
CPC ..... *F15D 1/005* (2013.01); *F15D 1/12* (2013.01)

(58) Field of Classification Search
CPC ..... B61D 17/02; B62D 35/00; B63B 1/34; B63B 1/36; B64C 21/00; B64C 21/10; B64C 23/00; B64C 23/005; B64C 2003/148; B64C 2230/00; B64C 2230/02; B64C 2230/06; B64C 2230/08; B64C 2230/22; B64C 2230/24; F15D 1/005; F15D 1/06; F15D 1/12
See application file for complete search history.

(56) References Cited

U.S. PATENT DOCUMENTS

| | | | |
|---|---|---|---|
| 2,873,931 | A | 2/1959 | Fleischmann |
| 3,091,505 | A | 5/1963 | Reaser |
| 3,592,329 | A | 7/1971 | Fleischauer |
| 4,070,275 | A | 1/1978 | Stoev |
| 4,706,910 | A | 11/1987 | Walsh |
| 4,932,612 | A | 6/1990 | Blackwelder |
| 5,246,331 | A | 9/1993 | Hallahan |
| 5,445,095 | A | 8/1995 | Reed |
| 5,595,205 | A | 1/1997 | Sirovich |
| 5,755,408 | A | 5/1998 | Schmidt |
| 5,803,410 | A | 9/1998 | Hwang |
| 5,833,389 | A | 11/1998 | Sirovich |

(Continued)

FOREIGN PATENT DOCUMENTS

| | | |
|---|---|---|
| DE | 3718003 A1 | 12/1988 |
| JP | 5435798 B2 | 5/2014 |

(Continued)

*Primary Examiner* — Zachary M Davis
(74) *Attorney, Agent, or Firm* — Yohannan Law; David R Yohannan

(57) ABSTRACT

A controlled turbulence system is disclosed to have a surface and means configured to induce a first wave form in a working fluid along the surface. Some embodiments of the invention may include a second means configured to induce a second wave form in the working fluid, wherein the first wave form and the second wave form have different frequencies. The first and/or second means may be provided as fields of pockets formed in the surface or wave-based generators.

21 Claims, 16 Drawing Sheets

(56) References Cited

U.S. PATENT DOCUMENTS

| | | | |
|---|---|---|---|
| 5,934,611 | A | 8/1999 | Tindell |
| 5,934,622 | A | 8/1999 | Meng |
| 5,941,481 | A | 8/1999 | Snarski |
| 6,119,987 | A | 9/2000 | Kiknadze |
| 6,520,455 | B2 | 2/2003 | Kamiadakis |
| 6,626,612 | B2 | 9/2003 | Knapp |
| 7,004,094 | B2 | 2/2006 | Carson |
| 7,152,829 | B2 | 12/2006 | Bertolotti |
| 7,874,525 | B2 | 1/2011 | Miller |
| 7,922,126 | B2 | 4/2011 | Meister |
| 7,993,492 | B2 | 8/2011 | Cabrera Y Lopez Caram |
| 9,002,484 | B2 | 4/2015 | Hyde |
| 9,004,399 | B2 | 4/2015 | Jain |
| 9,067,674 | B2 | 6/2015 | Nordin |
| 9,114,940 | B2 | 8/2015 | Kraegeloh |
| 9,505,558 | B2 | 11/2016 | Bott |
| 9,845,902 | B2 | 12/2017 | Loveday |
| 9,994,301 | B2 | 6/2018 | Kruckenberg |
| 2004/0135424 | A1 | 7/2004 | Ording |
| 2005/0003146 | A1 | 1/2005 | Spath |
| 2010/0206038 | A1 | 8/2010 | Vitagliano |
| 2013/0306177 | A1 | 11/2013 | Bonutti |
| 2015/0336659 | A1 | 11/2015 | Zhong et al. |
| 2016/0201699 | A1 | 7/2016 | Heikenfeld |
| 2016/0318602 | A1 | 11/2016 | Whalen |
| 2017/0174318 | A1* | 6/2017 | Beckman ..... B64C 27/463 |
| 2018/0023599 | A1 | 1/2018 | Hussein |
| 2018/0201361 | A1* | 7/2018 | Garc A Nieto ..... B64C 21/08 |

FOREIGN PATENT DOCUMENTS

| | | | |
|---|---|---|---|
| SU | 577516 | A1 | 12/1977 |
| SU | 909384 | B | 2/1982 |

* cited by examiner

CONTROLLED TURBULENCE SYSTEM

CROSS REFERENCE TO RELATED APPLICATIONS

This application relates to and claims the priority of U.S. provisional patent application Ser. No. 62/722,333 that was filed Aug. 24, 2018 and entitled Controlled Turbulence System.

FIELD OF THE INVENTION

One or more embodiments of the present invention relate to systems and methods for creating a controlled turbulence boundary layer adjacent to a surface in a working fluid.

BACKGROUND OF THE INVENTION

Many methods and apparatus depend upon the flow of fluid or are required to move relative to a fluid for proper operation. For example, vehicles travel through air, and fluidized bed mixers generate fluid flows to accomplish mixing. The number of such examples is virtually limitless. Two predominate needs are known to exist for systems and methods requiring fluid flow: (i) control of the fluid flow and (ii) the reduction of drag associated with fluid flow. Both control and reduced drag can be accomplished, at least in part, by introducing controlled turbulence into a fluid. In some instances, controlled turbulence can be used to create defined boundary layers in a fluid that can be used to control fluid flow and/or reduce drag. Accordingly, there is a need for systems and methods for inducing controlled turbulence in a fluid.

One or more embodiments of the present invention generally relate to systems and methods for creating controlled turbulence in a fluid that may create a vortex-based boundary layer above a surface. An example system may create an ordered boundary layer that is not laminar through the use of a field of pockets on at least one surface. Alternately, another example system may create a boundary layer through the use of fluid flows or fluid agitation to create at least a two-dimensional interference pattern which may act like a virtual surface that mimics the effect on the fluid of a field of features, such as pockets and grooves. These systems may be employed as a fluid flow modifier on or within at least one surface.

The example system embodiments may further employ adjustability of the generated controlled turbulence by varying structural parameters or fluid flow/agitation properties thereby permitting variability of the controlled turbulence generated. A control system may be used to maintain the desired controlled turbulence, via feedback, regardless of varying conditions within the system. The system embodiments may further employ adjustability of the generated controlled turbulence by imparting external energy into the system through the use of pressure waves (such as ultrasound), particle radiation (such as photons, protons, or electrons), or other fields (such as magnetic, electromagnetic, or electrostatic fields) to induce a frequency based effect with resonant amplifying or dampening results within the field of features on a surface or the at least two-dimensional interference pattern acting like a virtual surface.

Some, but not necessarily all embodiments of the present invention may provide a fluid flow modifying action using a pattern and/or field of multiple sized pockets to create varying flow modification within the pattern and/or field to impart an additional axis of rotation for the turbulent motion of fluid flow. This additional axis of rotation may impart coherence of fluid flow motion past the physical structures of the system. Some, but not necessarily all embodiments of the present invention may use a pattern and/or field of multiple sized holes to impart an additional axis of rotation for the turbulent motion to more efficiently direct a pressure wave.

Fluid flow modifying action using a pattern and/or field of multiple sized pockets may also be used to induce harmonic resonance or disharmony within the fluid flow between a multitude of pockets. This harmonic resonance or disharmony may modify the action of the system due to the created wave interference patterns within standing fluid and/or within fluid flow in the system. In one example, the fluid flow modifying action may be provided on the surface of an inside barrel diameter in a device to impart a touchless gyroscopic spin to a projectile thereby decreasing drag and increasing distance and accuracy of the projectile.

It is appreciated that embodiments of the present invention may provide a contactless drag reduction effect, and/or a self-centering effect for a projectile, and/or a down-force effect for a projectile. These effects may be useful, for example, for high-speed trains in tunnels or on monorails to reduce drag and maintain wheel contact with the track. A pattern and/or field of multiple sized pockets may also impart a fluid guiding action and a vibration dampening action.

Still some other embodiments of the present invention may use a pattern and/or field of features paired with a more traditional means of sealing, such as gaskets, rings, and the like. This may allow the flow modifying action to activate upon surface deformation from heat and/or pressure; thereby allowing the use with a gasket or other conventional seal to increase sealing capacity in applications such as internal combustion engines and other pressure vessels.

Some, but not necessarily all embodiments of the present invention also may provide an adjustable flow modifying action which may be created by adjusting the position of the fluid flow modifying action surface using at least one moveable surface. In one example, adjustable flow modifying action may be created by adjusting the distance between pockets by using a deformable surface. In another example, an adjustable flow modifying action may be created by adjusting the depth of the pockets by using a deformable surface or a by using billowed pockets. In yet another example, an adjustable flow modifying action may be created by using at least one group of adjustable depth pockets within the field of features by methods such as moveable pins within the pockets.

Some, but not necessarily all embodiments of the present invention may provide a flow modifying action that creates a pumping action, an accelerating action, and/or a compressing action. In some embodiments, these actions may be implemented by moving or deforming a surface within the pattern and/or field of features.

It is appreciated that still some other embodiments of the present invention may provide an adjustable flow modifying action which may be self-cleaning due to: movements of surfaces or pocket depths to remove dust, dirt, ice, etc. via selective coatings applied to at least one surface within the field of features, and/or heating and/or cooling mechanism applied to at least one surface within the field of features, and/or magnetic, electrostatic, or other field(s) applied to at least one surface within the field of features.

In some, but not necessarily all embodiments of the present invention, an adjustable flow modifying action may be provided in response to a feedback loop. Adjustable flow modifying action may be provided through automatic adjustment by a control system. Adjustable flow modifying action also may be implemented by imparting additional energy to harmonically agitate or depress the flow modifying action in the field of features such as pockets. The additional energy may be imparted to all or just a sub-group of pockets within the pattern and/or field. For example, ultrasonic agitation may be used to harmonically agitate or depress the flow modifying action.

Some, but not necessarily all embodiments of the present invention may provide a controlled leak rate which may be employed in mixing devices such as reaction chambers for chemical reactions. A controlled leak rate may be employed in conjunction with the supply of additional energy to produce shockwave mixing devices such as reaction chambers for high pressure reactions. A controlled leak rate also may be employed to create a motionless on/off valve or a motionless proportional valve, with minimal leakage.

While embodiments of the invention are not limited to use in aeronautics applications, automotive and marine aerodynamic applications, proportional or on/off valve applications, failsafe sealing applications, mixing applications, pumping applications, compressing applications, chemical reaction applications, and physical properties modification applications, these enumerated applications may benefit from the invention. Many other devices besides those enumerated may benefit from the use of one or more embodiments of this invention as well.

It is appreciated that embodiments of the present invention may be scaled larger or smaller in response to adjustable flow modifying action needs, substances involved, and desired effects by scaling the pattern area, the feature dimensions within the pattern area, the number of features within the pattern area, the spacing between features, and other geometric dimensions of the system.

OBJECTS OF THE INVENTION

Accordingly, it is an object of some, but not necessarily all embodiments of the present invention to provide a fluid flow modifying action using a pattern and/or field of features on a surface so as to create a flow modifying action by creating controlled turbulent motion over the pattern and/or field of features. These features may include but are not limited to pockets and equalizing grooves.

It is another object of some, but not necessarily all embodiments of the present invention to create a flow modifying action which may be between the flow modifying surface and another surface or a "virtual surface" created by ultrasound, magnetics, light, electro-static fields, quantum effect fields, other flows, at the boundary of the fluid, at the boundary between the fluid and the fluid containing additional materials, or at boundaries between fluids.

SUMMARY OF EMBODIMENTS OF THE INVENTION

Responsive to the foregoing challenges, Applicant has developed an innovative controlled turbulence system comprising: a surface configured to be provided adjacent to a working fluid; a first means configured to induce a first wave form in the working fluid along the surface adjacent to the working fluid; a second means configured to induce a second wave form in the working fluid along the surface adjacent to the working fluid, wherein the first wave form and the second wave form have different frequencies, and wherein the first wave form and the second wave form cooperate in the working fluid to create a turbulence boundary layer in the working fluid along the surface.

Applicant has further developed an innovative controlled turbulence system comprising: a surface; a plurality of laterally spaced pockets arranged in plurality of rows to form a first field of pockets on or through the surface; and an apparatus configured to vary one or more dimensions of the plurality of laterally spaced pockets, wherein the apparatus and the plurality of laterally spaced pockets are configured to cooperate to create a turbulence boundary layer in a working fluid provided along the surface.

Applicant has still further developed an innovative method of creating a turbulence boundary layer in a working fluid along a surface adjacent to the working fluid, comprising the steps of: inducing a first wave form in the working fluid along the surface adjacent to the working fluid; inducing a second wave form in the working fluid along the surface adjacent to the working fluid, wherein the first wave form and the second wave form have different frequencies, and wherein the first wave form and the second wave form cooperate in the working fluid to create a turbulence boundary layer in the working fluid along the surface.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only and should not be construed as limiting the invention.

DETAILED DESCRIPTION OF EMBODIMENTS OF THE INVENTION

Figure 1:
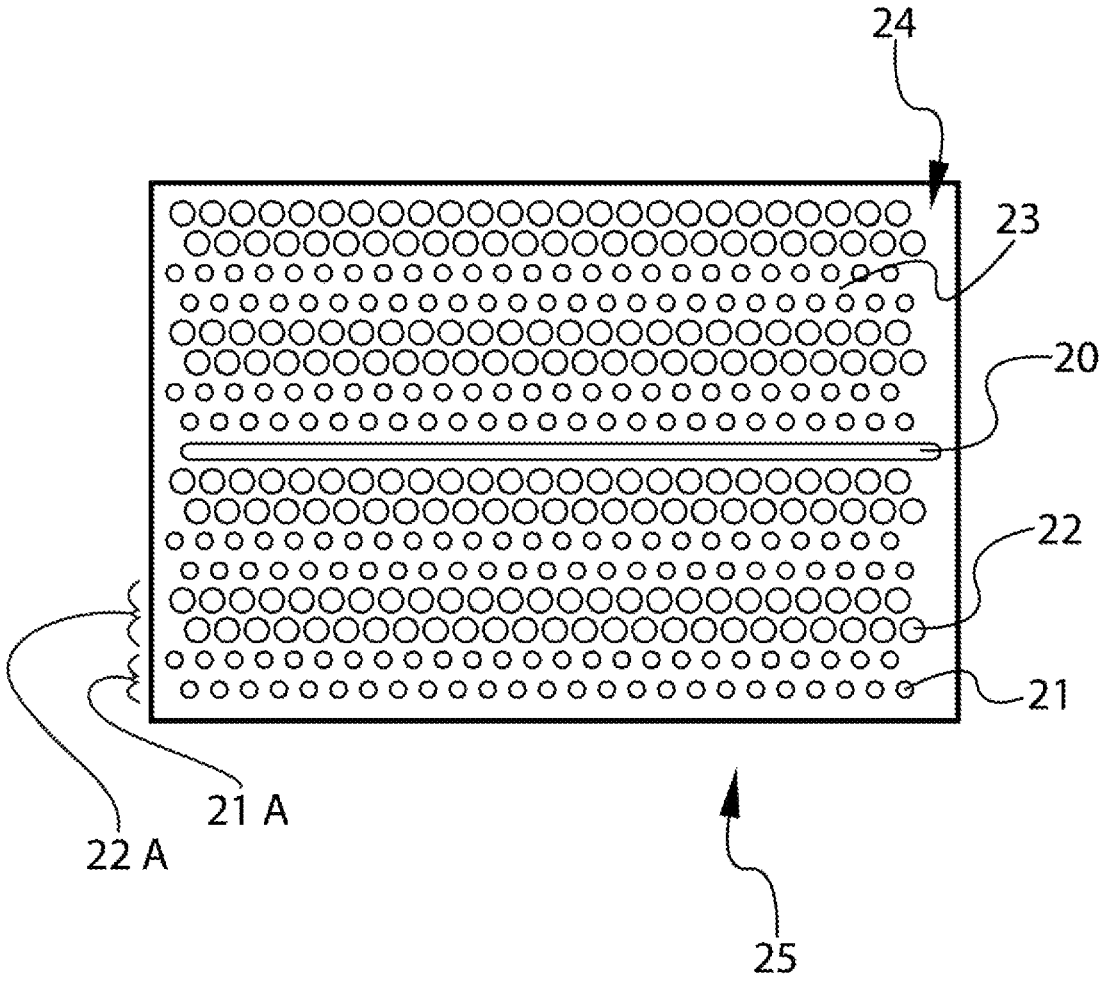
FIG. 1 is a plan view of a controlled turbulence system in accordance with a first embodiment of the invention.
Figure 2:
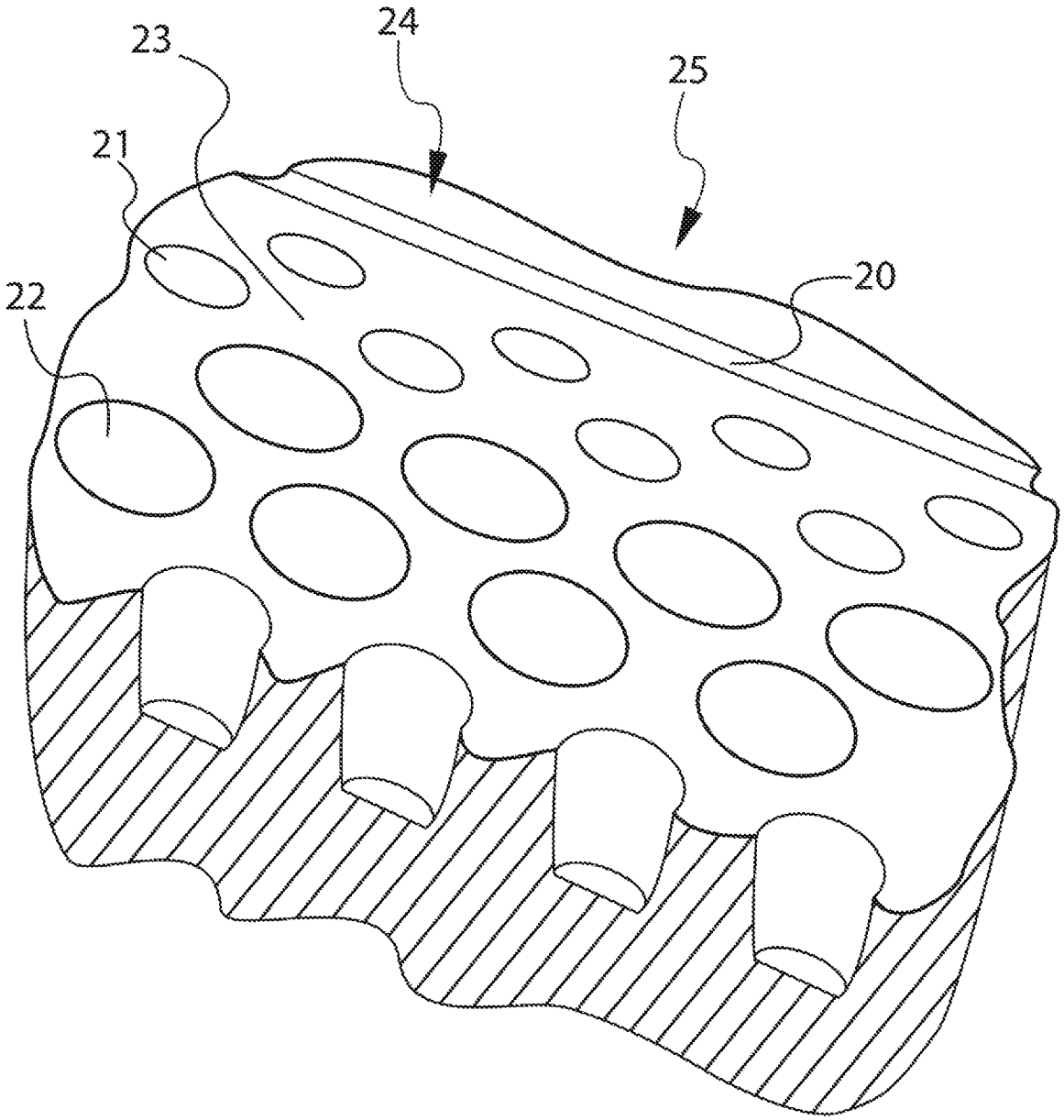
FIG. 2 is an isometric enlarged view of a portion of the controlled turbulence system illustrated by FIG. 1.
Figure 3:
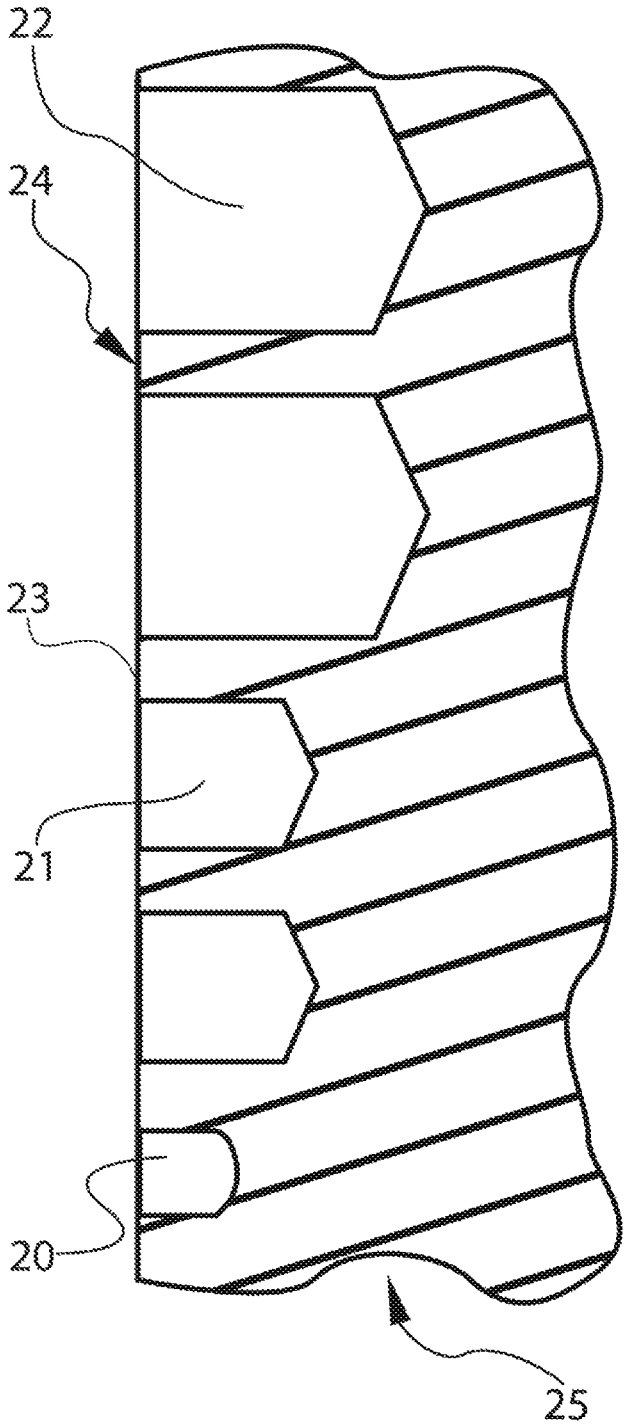
FIG. 3 is cross-sectional enlarged view of a portion of the controlled turbulence system illustrated by FIG. 1.

Reference will now be made in detail to embodiments of the present invention, examples of which are illustrated in the accompanying drawings. With reference to FIGS. 1-3, in a first embodiment of the invention, a controlled turbulence system 25 is provided on or through a surface 24. The surface 24 may be provided in a working space that may receive a working fluid, such as but not limited to air. The controlled turbulence system 25 may include: (i) a first plurality of laterally spaced recesses or pockets 21 arranged in plurality of rows to form a first field of pockets 21A on or through the surface, (ii) a second plurality of laterally spaced pockets 22 arranged in plurality of rows to form a second field of pockets 22A on or through the surface, and (iii) one or more equalizing grooves 20 on or through the surface. Lands 23 comprising the undisturbed portion of the surface 24 may separate each of the pockets 21, 22 and equalizing grooves 20 from each other.

Applicant regards pockets 21, 22 and grooves 20 formed "on" the surface 24 to mean the same thing as being formed "in" the surface. In both cases, the pockets 21, 22 and grooves 20 extend inward from the outer most surface of the surface 24 surrounding the pockets and grooves.

Preferably, but not necessarily, the first pockets 21 in the first field 21A may be of like dimension in terms of overall shape, shape at the mouth, shape at the base, height, width, diameter, depth, and/or volume. Similarly, the second pockets 22 in the second field 22A may be of like dimension in terms of overall shape, shape at the mouth, shape at the base, height, width, diameter, depth, and/or volume. The first pockets 21 may be arranged in the first field 21A in at least one row, or more preferably, in a grid or array pattern consisting of two or more spaced columns and rows of like pockets. Similarly, the second pockets 22 may be arranged in the second field 22A in at least one row, or more preferably, in a grid or array pattern consisting of two or more spaced columns and rows of like pockets. The number, shape, size and arrangement of the lands 23, pockets 21, 22 and equalizing grooves 20 shown in the drawing figures were selected for ease of discussion and illustration and are not considered limiting. Alternatively, the pockets in the first and second fields 21A, 22A may be spaced in a pattern with variation in the spacing between the pockets and/or fields.

Pocket 21, 22 depths that are generally 1.5 or greater times the pocket diameter or greater may be superior in terms of ability to create a controlled turbulence boundary layer in a working fluid. Pocket depths less than this may tend to produce less powerful vortexes and/or less controlled turbulence. These less powerful effects may tend to increase the flow acceleration much closer to the surface 24 on which the pockets 21, 22 are provided.

Figure 10:
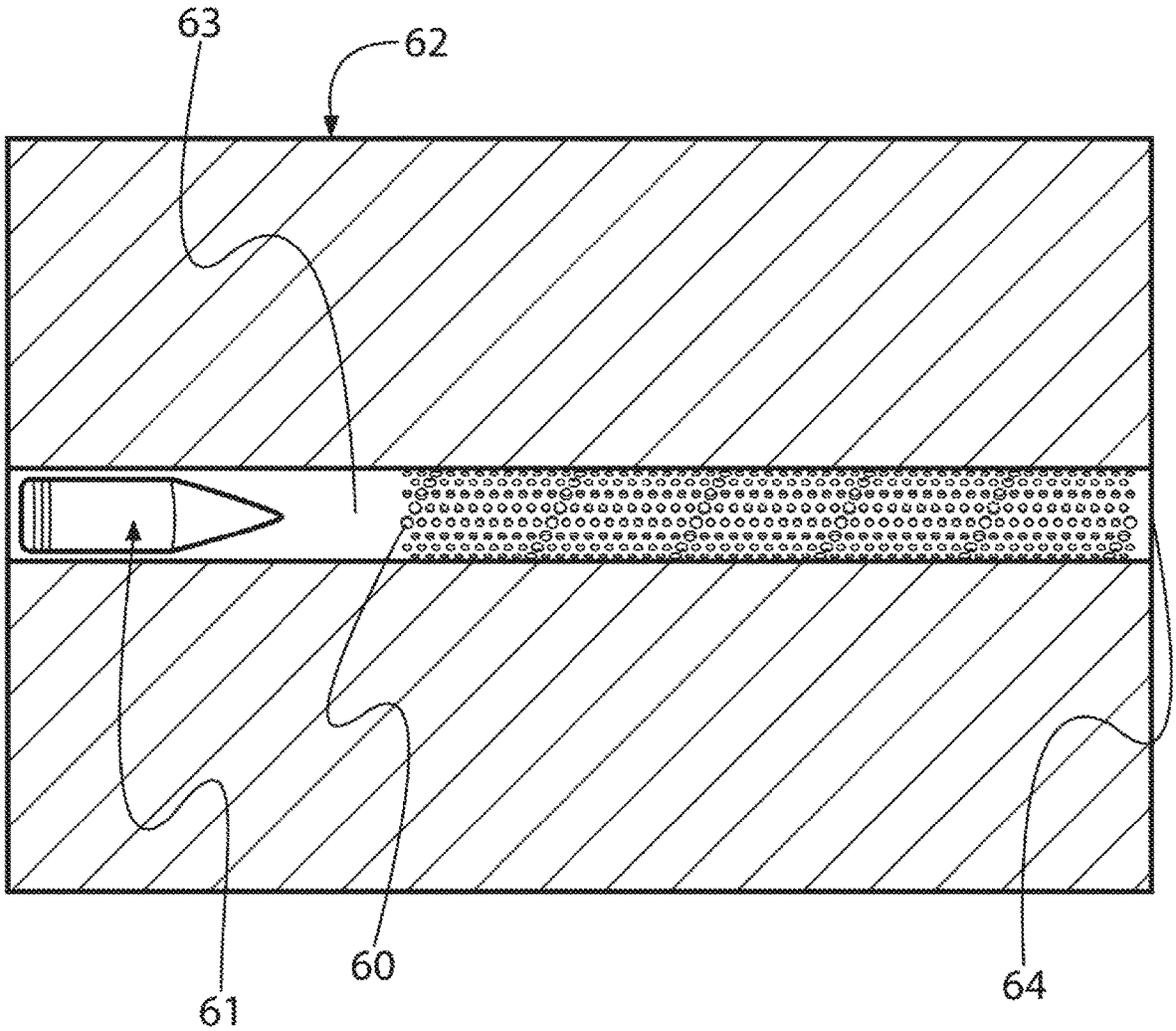
FIG. 10 is a partial cross-sectional view of a controlled turbulence system embodiment of the invention used to create a fluid boundary layer around a projectile.
Figure 11:
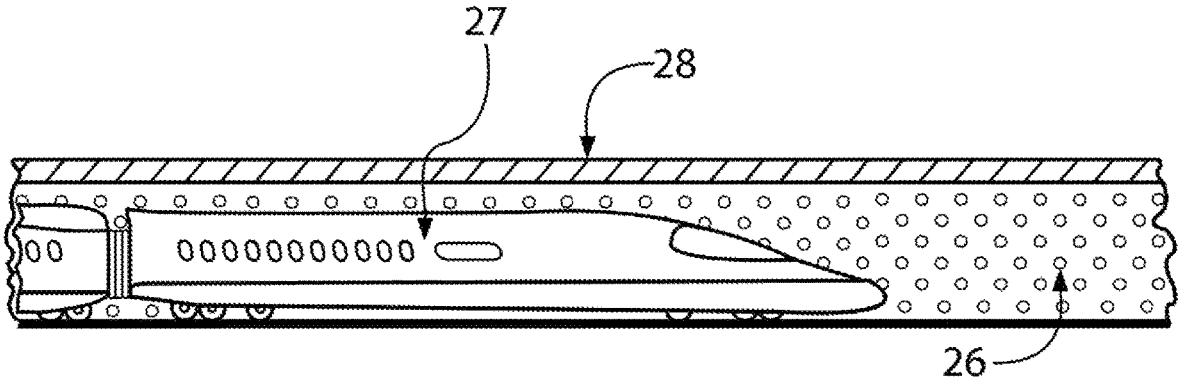
FIG. 11 is a partial cross-sectional view of a controlled turbulence system embodiment of the invention used to create a fluid boundary layer around a vehicle.
Figure 12:
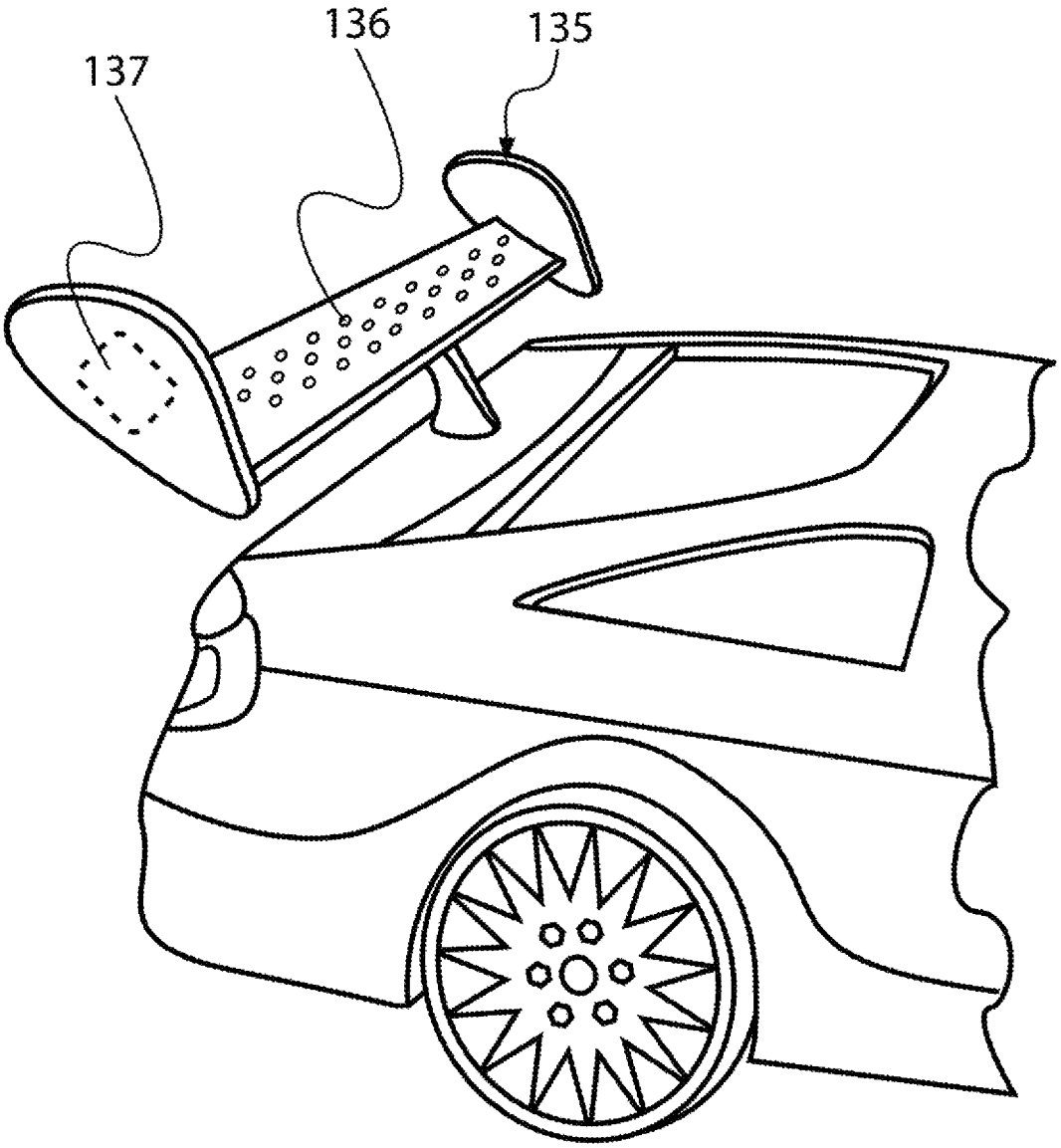
FIG. 12 is a pictorial view of a controlled turbulence system embodiment of the invention used to create fluid boundary layer adjacent to an airfoil.

Each of the first and second fields 21A and 22A of pockets 21, 22 may extend in two (x and y) dimensions on a planar surface or extend in two dimensions on the surface of an object curved in space (e.g., see FIGS. 10-12). Each of the pockets 21, 22 in the first and second fields 21A and 22A may be aligned with pockets in the same field in adjacent rows and/or columns, aligned with the pockets disposed in rows and/or columns set one or more intervening rows and/or columns away, or unaligned with each other. Preferably, each of, or the combination of, the first and second fields 21A and 22A of pockets 21, 22 includes two or more pockets spaced from each other in the x direction and two or more pockets spaced from each other in the y-direction. Further, preferably the dimension or size of each of the pockets 21, 22 at the mouth is significantly smaller than the dimension of the surface on which it is disposed (i.e., the fields 21A and 22A dimensions) when measured in either the x or y direction. More preferably, the dimension or size of each of the pockets 21, 22 at the mouth is significantly smaller than the dimension of the surface on which it is disposed when measured in both the x and y direction. By significantly smaller, it is meant that the dimension or size of each pocket at the mouth is less than half, and more preferably, less than one quarter, of the dimension of the surface on which it is disposed when measured in the x and/or y direction. Further, the total surface area in the fields 21A and 22A (e.g., the surface 24) occupied by the lands 23 preferably exceeds the total surface area attributable to the mouths of the pockets 21, 22 in the first and second fields 21A and 22A.

Figure 4:
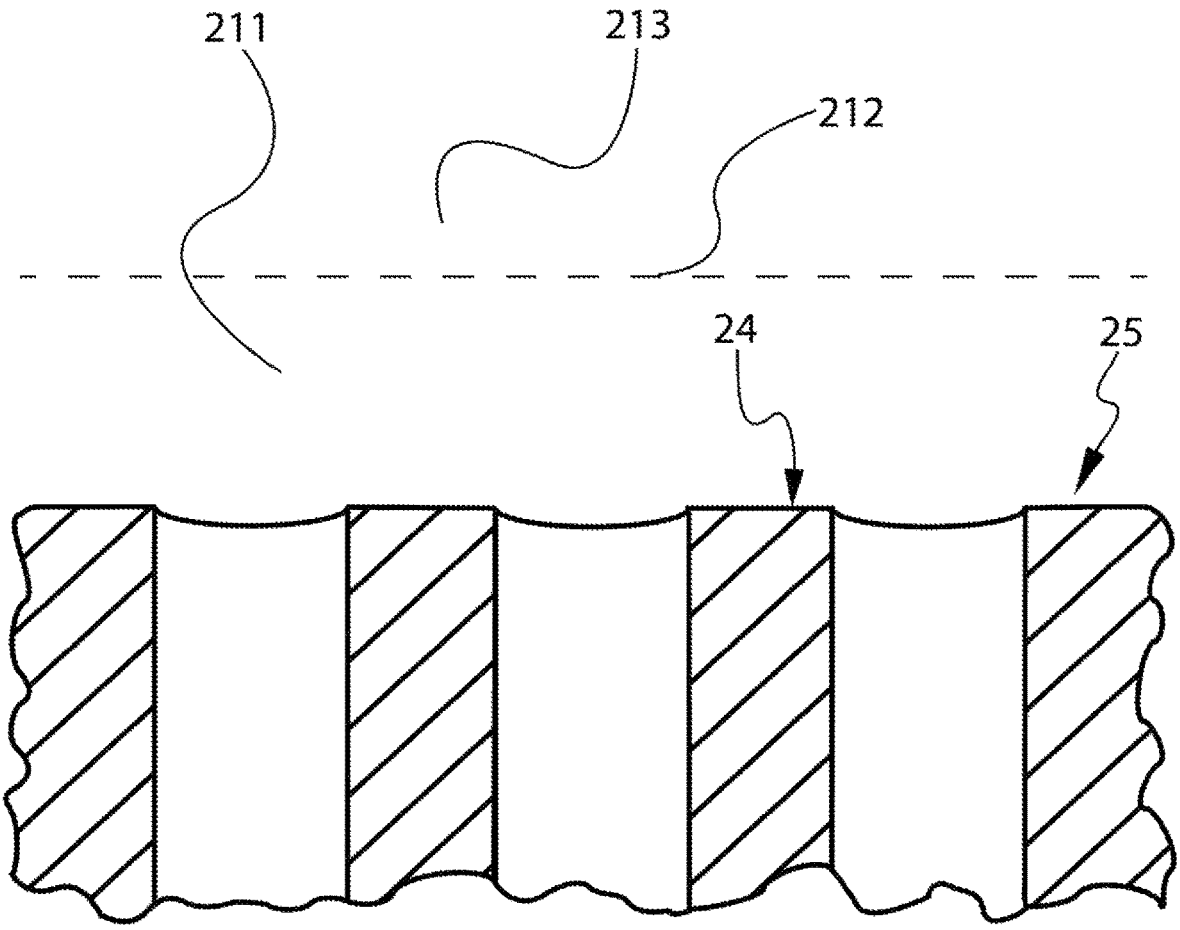
FIG. 4 is a cross-sectional enlarged view of a portion of the controlled turbulence system and controlled turbulence boundary layer in accordance with the first embodiment of the invention.

With reference to FIG. 1, a controlled turbulence boundary layer may be produced in the working fluid adjacent to the surface 24 when there is relative motion between the working fluid and the surface due to the presence of the first and second pockets 21, 22 and lands 23 arranged in appropriate fields 21A and 22A on the surface. As illustrated in FIG. 4, the controlled turbulence system 25 on the surface 24 may create a proximal controlled turbulence area 211 in the working fluid adjacent to the surface. The proximal controlled turbulence area 211 may be an ordered area of vortex-based movement of the working fluid. A boundary 212 in the working fluid may separate the controlled turbulence area 211 from a distal reduced turbulence area 213 of the working fluid. This boundary 212 may not be a planar shape parallel with the surface 24 in which the controlled turbulence area 211 is formed. Instead, the boundary 212 may have a finite thickness and be more accurately characterized as a boundary layer.

The proximal controlled turbulence area 211 may induce drag-reducing effects at the boundary 212. The distal reduced turbulence area 213 may have laminar motion due to the decreased drag. The proximal controlled turbulence area 211 may further induce an accelerating effect that may create accelerated laminar motion in the distal reduced turbulence area 213.

Should a second surface or equivalent (not illustrated) be provided in close proximity to the controlled turbulence system 25 formed in the first surface 24, it may decrease the thickness of the reduced turbulence area 213 or eliminate it completely based upon the amount of spacing between the two surfaces, surface and fluid characteristics, and ambient environment conditions. When the second surface or equivalent is provided in close proximity to the controlled turbulence system 25 in the first surface 24, it also may decrease the thickness of the controlled turbulence area 211 or eliminate it completely based upon the same factors.

The proximal controlled turbulence area 211 boundary layer 212 may be generated as the result of the pressure difference in the working fluid caused by the pockets 21, 22. As the working fluid experiences motion relative to the surface 24, the pressure and temperature of the working fluid may rise and produce a working fluid pressure differential between the rows of pockets 21, 22. The speed and pressure change of the working fluid may be a function of the geometry and arrangement of the pockets 21, 22.

With continued reference to FIGS. 1-4, the pockets 21, 22 preferably may have relatively sharp edges at the junction of the pocket mouth with the face of the surface 24, i.e., at the junction with the lands 23. As the working fluid flows over the sharp edge of a pocket 21, 22, a decrease in local pressure may occur due to turbulence. As a result, the working fluid may expand creating a momentary decrease in pressure and an increase of localized turbulence. Further working fluid flowing over and into each successive pocket 21, 22 may begin a cycle wherein each pocket 21, 22 serves as a resonator (e.g., Helmholtz-like resonator), which may cause the working fluid to be drawn into and expelled out of the pocket 21, 22 at a definable frequency creating further localized turbulence. The resulting turbulence may be a function of the physical properties of the working fluid in the system and the diameter (or height and width), internal geometry, relational location, and depth of each individual pocket 21, 22 in the first and second fields 21A and 22A.

As a result of the foregoing, each pocket 21, 22 and equalizing groove 20 may induce a wave form in the working fluid having a select frequency and wave behavior which may be dependent upon its dimensions, such as diameter and depth, internal volume, external volume surrounding the feature, and other attributes, such as but not limited to surface roughness, sharp or smooth edges, and internal geometric shapes which may include a neck-down area similar to a de Laval nozzle (not illustrated) and/or a resonant chamber similar to a Helmholtz-like resonator. Applicant uses the terms "wave" and "wave form" interchangeably.

Therefore, the pattern of such pockets 21, 22 within a controlled turbulence system may induce and/or respond to frequencies and the associated harmonic resonances in odd or both even and odd harmonics, dependent upon the materials in the system and location and geometry of such pockets, as a course of normal intended function of the system. These frequencies and wave phenomenon may interact in a pattern due to propagation delay, transmission media properties, reflection/refraction patterns, transmission losses, and the geometry of the area(s) in which these waves propagate. The wave forms may induce coherent motion phenomenons that may be vortexes that may create the boundary layer.

The waves may merge in multi-dimensional (2D and 3D) emission patterns within the controlled turbulence system with such operations as but not limited to: addition, subtraction, multiplication, division, powers, and functions. These wave interactions may induce other phenomenon, such as but not limited to vortexes, spirals, and directional forces. These phenomena may be time dependent with regard to their magnitudes, orientations, directions, or other such quantifiable characteristics. These phenomena also may be dependent upon material movement, field strength, wave strength, or applied energies to or within the controlled turbulence system. These phenomena may give rise to secondary, tertiary, etc. effects that may further depend on the construction materials used within the system.

The geometry of the controlled turbulence system, including but not limited to the geometry of the pockets 21, 22, may induce harmony or dis-harmony of the resulting phenomenon (i.e., vortices, spirals, and directional forces) which may be induced by the pattern of pockets 21, 22 and equalizing grooves 20 within the controlled turbulence system 25. Should harmonic resonance be a desired behavior of the system, it may be advantageous to use musical notes and octaves as a functional construct wherein musical notes are $2^{(1/12)}$ multiplicative or divisive steps from a defined base frequency. Octaves are a full range of twelve notes, such that like notes in different octaves are mathematically related by a doubling or halving of one of the frequencies. As a result, pockets or other features generating harmonious notes (e.g., those separated by one full octave) forming chords and frequency-wave functions may be used to achieve a controlled turbulence system.

Controlled turbulence systems may be designed to induce frequencies that combine in a manner to emulate chords by selecting pocket or other feature geometries to induce emission patterns and frequencies that interact in a definable and desirable physical manner. These chords may induce effects which, when examined as a whole, may produce functional effects greater than the effects of individual component contributions. These effects may result from internal cooperative wave interactions producing harmonic effects within the wave field. This may induce other features to have strengthened or weakened function within the controlled turbulence system pattern in a time and/or space dependent function. The functional result of which may be tailored by the controlled turbulence system pattern design for its intended functional scale, application, and materials within or interacting with the system.

The material used to create surface 24 on which the first and second fields 21A and 22A are provided may also impact the resulting turbulent effect. Some materials, particularly alloys and composites, may have tunable inherent resonant frequencies that may be dependent upon the geometry of the components, the percentages of materials used in the alloy or composite, the materials used in the alloy or composite, heat and surface treatments, and the intended operating temperature of the controlled turbulence system 25. Therefore, intended operational temperatures and fault condition temperatures should be considered when designing the system 25.

Wave patterns produced by a pattern and/or field of pockets 21A, 22A and/or equalizing grooves 20 (collectively, "features") may be proportional to the scale of the system and materials forming the features. For example, a small controlled turbulence system 25 pattern of features may induce atomic scale or sub-atomic scale waves in such spectrums as the electro-magnetic spectrum or it may induce quantum scale wave effects. These waves may induce secondary, tertiary, etc. effects within other materials to produce other desirable system functions, such as but not limited to sound emissions, light emissions, energetic particle emissions, quantum spin orientation, electrostatic fields, magnetic fields, or voltage/current flow control. Similarly, large-scale effects may be produced when the controlled turbulence system 25 pattern is created on a large scale. The system as a whole may be increased proportionally in all respects from small scale to large scale. Alternatively, the system may be scaled to a larger surface by merely changing the number and/or type of features and/or the spacing between such features.

Figure 5:
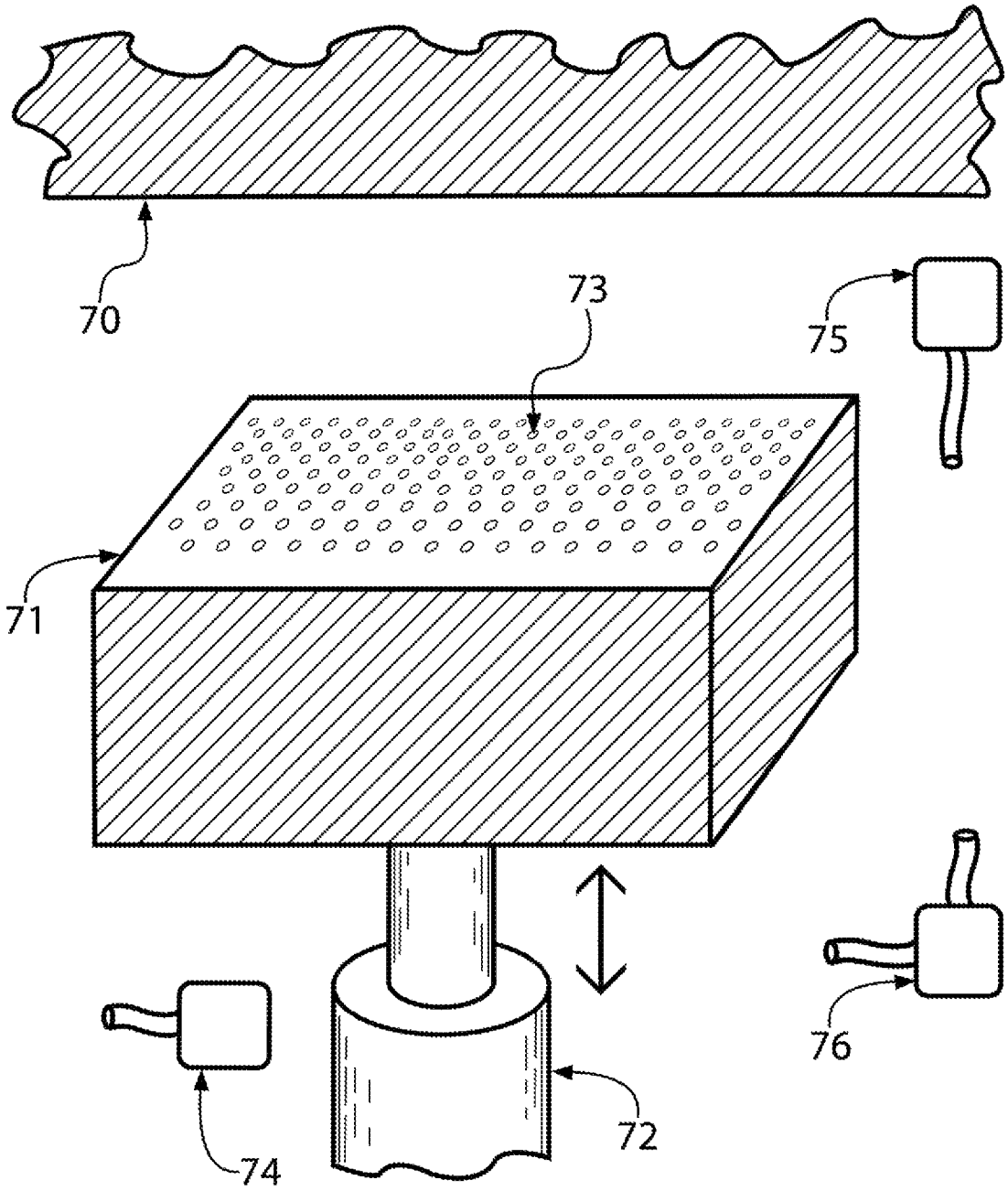
FIG. 5 is a partial cross-sectional and side isometric view of a controlled turbulence system in accordance with a second embodiment of the invention.

In a second embodiment of the invention, mechanical methods may be employed to allow adjustability of the controlled turbulence system. As illustrated in FIG. 5, a moveable surface 71 may be used to adjust the effects generated by the controlled turbulence system 73. The controlled turbulence system 73 may be provided on the moveable surface 71, the optional stationary surface 70 (not illustrated), or both. It also is appreciated that the controlled turbulence system patterns may be different on different surfaces. It is appreciated that a virtual surface, a fluid boundary, or fluid flows may functionally replace the optional stationary surface. A surface position actuator 72 may move the moveable surface. However, it is appreciated that the surface 71 may be moved by manual means, such as but not limited to adjustment screws or other manual positioning devices such as cams. The position of the actuator 72 and/or the moveable surface 71 may be detected by a position sensor 74. The flow, pressure, temperature, and other quantifiable measurements may be detected by a feedback sensor 75. A closed-loop feedback control system 76 may adjust the actuator 72 in response to position sensor 74, feedback sensor 75, and/or other optional additional control units (not illustrated).

Figure 6:
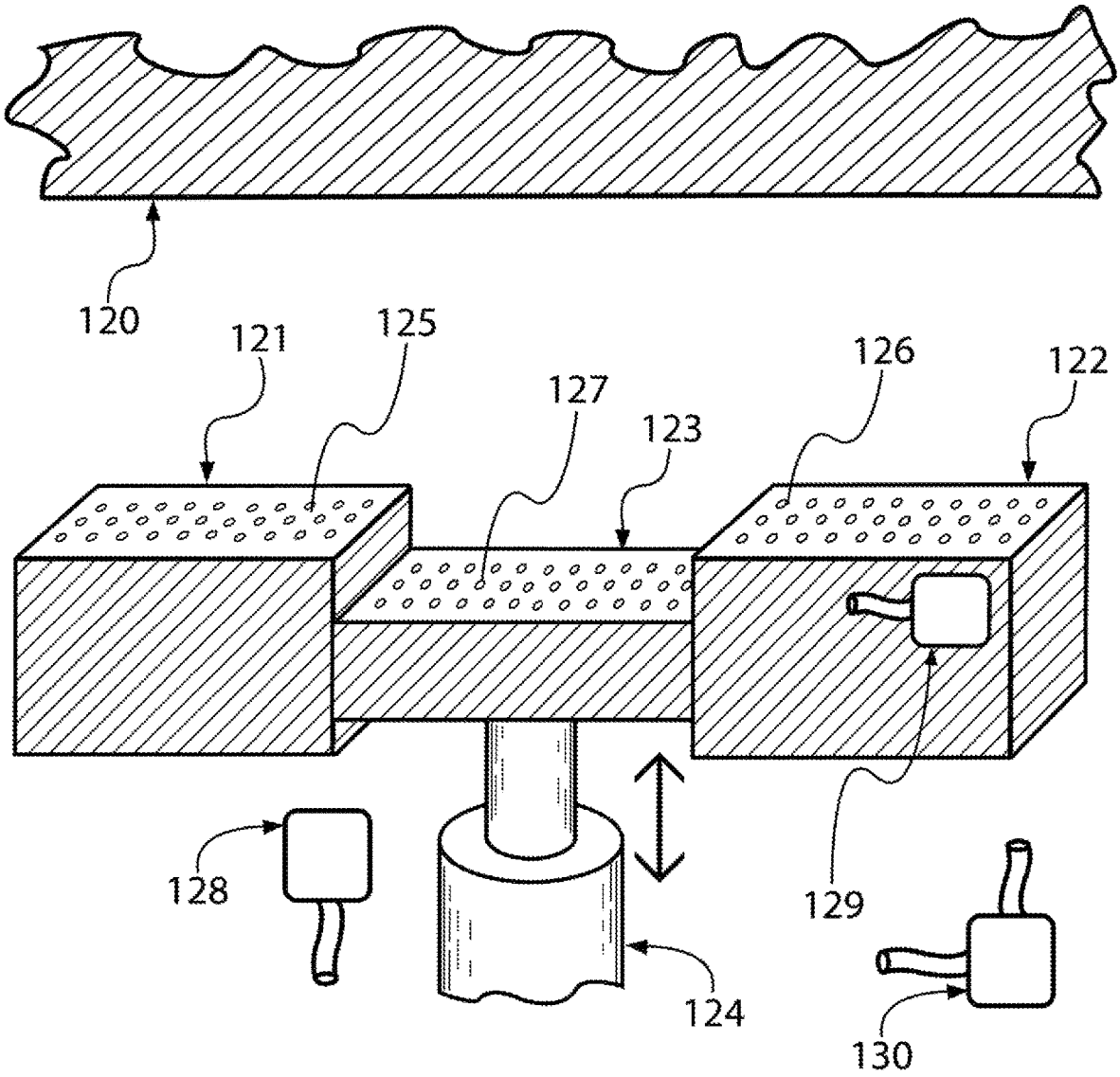
FIG. 6 is a partial cross-sectional and side isometric view of a controlled turbulence system in accordance with a third embodiment of the invention.

As further illustrated in FIG. 6, in a third embodiment of the invention a moveable surface 123 may be provided adjacent to other fixed surfaces 121 and 122. Fixed surface 121 and fixed surface 122 may work cooperatively with the moveable surface 121. Optional fixed or moveable surface 120 may be provided opposing the other surfaces. It is appreciated that a virtual surface, a fluid boundary, or fluid flows may functionally replace any of the surfaces 120, 122, 123. Like or different controlled turbulence system patterns may be employed on multiple surfaces. It also is appreciated that the controlled turbulence system patterns may be different on different surfaces. In this specific example, a first controlled turbulence system pattern 125 may be employed on fixed surface 121, a second controlled turbulence system pattern 126 may be employed on fixed surface 122, and a third controlled turbulence system pattern 127 may be employed on the moveable surface 123. A controlled turbulence system pattern (not shown) may also be employed on the optional fixed surface 120.

With continued reference to FIG. 6, a surface position actuator 124 may move the moveable surface 123. However, it is appreciated that this surface may be moved by manual means such as but not limited to adjustment screws or other manual positioning devices such as cams. The position of the actuator or moveable surface may be detected by position sensor 128. The flow, pressure, temperature, or other quantifiable measurements may be read by closed-loop feedback sensor 129. A control system 130 may adjust the actuator in response to sensors and/or other optional additional control units (not illustrated). It also is appreciated that multiple independently moveable surfaces (not illustrated) may be provided within the controlled turbulence system to allow finer control or zone-based control of the controlled turbulence system.

Figure 7:
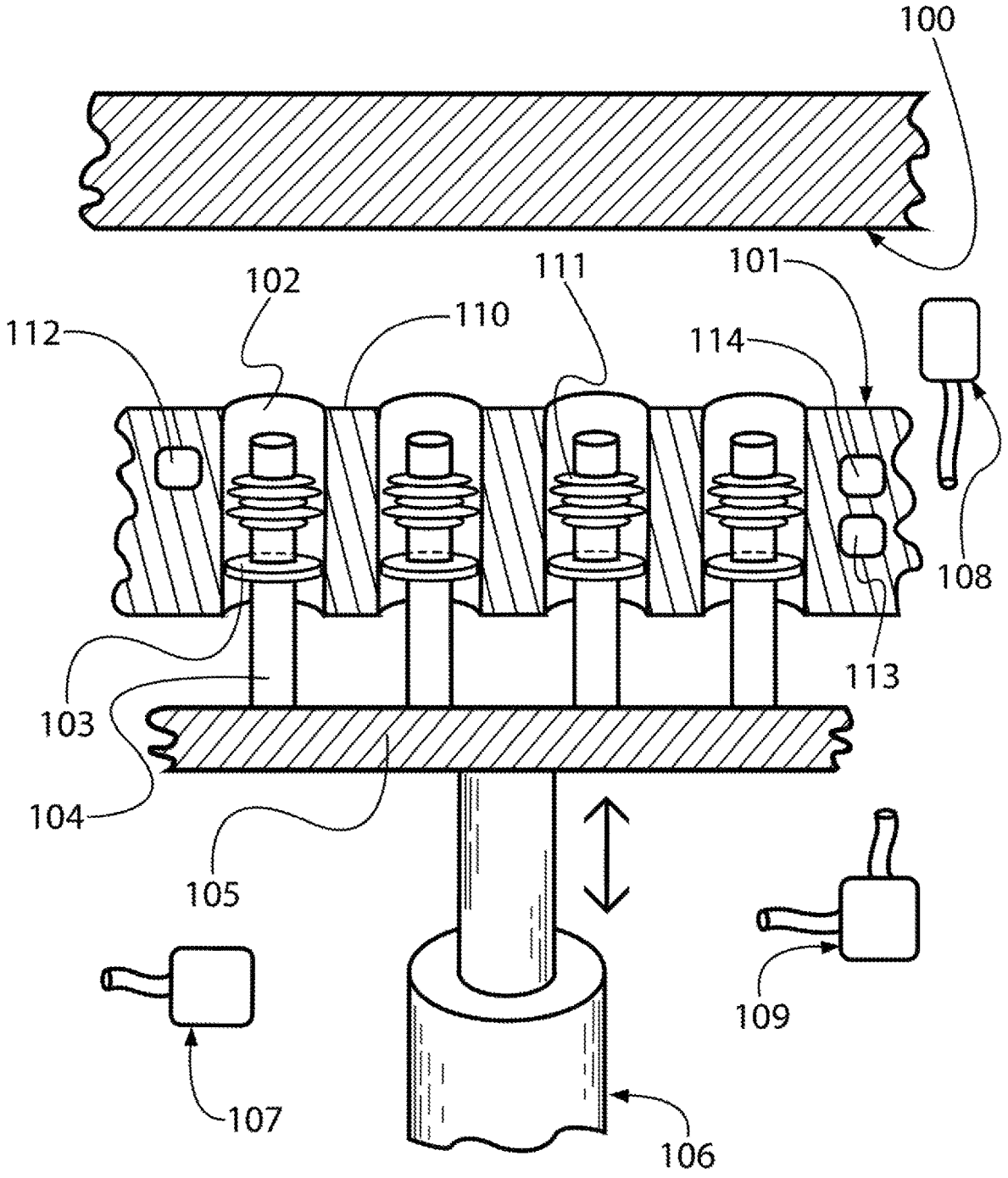
FIG. 7 is a partial cross-sectional and side isometric view of a controlled turbulence system in accordance with a fourth embodiment of the invention.

With reference to FIG. 7, in a fourth embodiment, a method of providing adjustability to the depth of the pockets 102 is illustrated. A surface 101 contains a field of pockets 102 which may each receive a moveable pin 104, thereby forming a controlled turbulence system. The surface 101 may contain other pattern features such as grooves (not illustrated) or non-adjustable pockets (not illustrated), and may include pockets/pins of differing dimensions (not illustrated) within the fields. The surface 101 and/or the pockets 102 may employ a surface coating 110 that is self-cleaning because it prevents or reduces the accumulation of matter on the coating. The surface 101 may further contain a heater 112, a field generator 113, and/or a wave generator 114 to assist in the prevention of the accumulation of matter on the surface. Each moveable pin 104 may include a scraper 111, which cleans the pocket as the pin moves up and down relative to the pocket, or more specifically, in the pocket parallel to the longitudinal orientation of the pocket which may not only adjust the size of the pocket but also prevent or reduce material accumulation on the pin and/or the wall of the pocket 102. However, the system may also be designed so that the scraper 111 protrudes above the top of the surface 101 during some system movements. This may further allow materials to be better removed from the pockets 102 due to fluid flow over the scrapers 111.

The pins 104 and/or the pockets 102 may incorporate a seal 103, such as but not limited to O-rings. The surface 101 may be opposed by an optional surface 100. It is appreciated that this optional surface 100 may be fixed or moveable (not illustrated) if present. It also is appreciated that the optional surface 100 may contain a controlled turbulence system pattern (not illustrated). It is appreciated that a virtual surface, a fluid boundary, or fluid flows may functionally replace the optional surface 100.

With continued reference to FIG. 7, the pins 104 may be contact a pin plate 105 that is connected to a pin plate actuator 106. It also is appreciated that each pin 104 may have its own actuator (not illustrated) or that separate groups of pins may each have an actuator (not illustrated) thereby allowing the controlled turbulence system to have finer control or zone-based control. However, it also is appreciated that the pins 104 may be moved by manual means such as but not limited to adjustment screws or other manual positioning methods such as cams. The position of the actuator 106, pins 104, and/or pin plate 105 may be detected by a position sensor 107. The flow, pressure, temperature, and/or other quantifiable measurements may be detected by a closed-loop feedback sensor 108. A control system 109 may adjust the actuator 106 in response to the sensors 107, 108, 109 and/or other optional additional control units (not illustrated).

Figure 8:
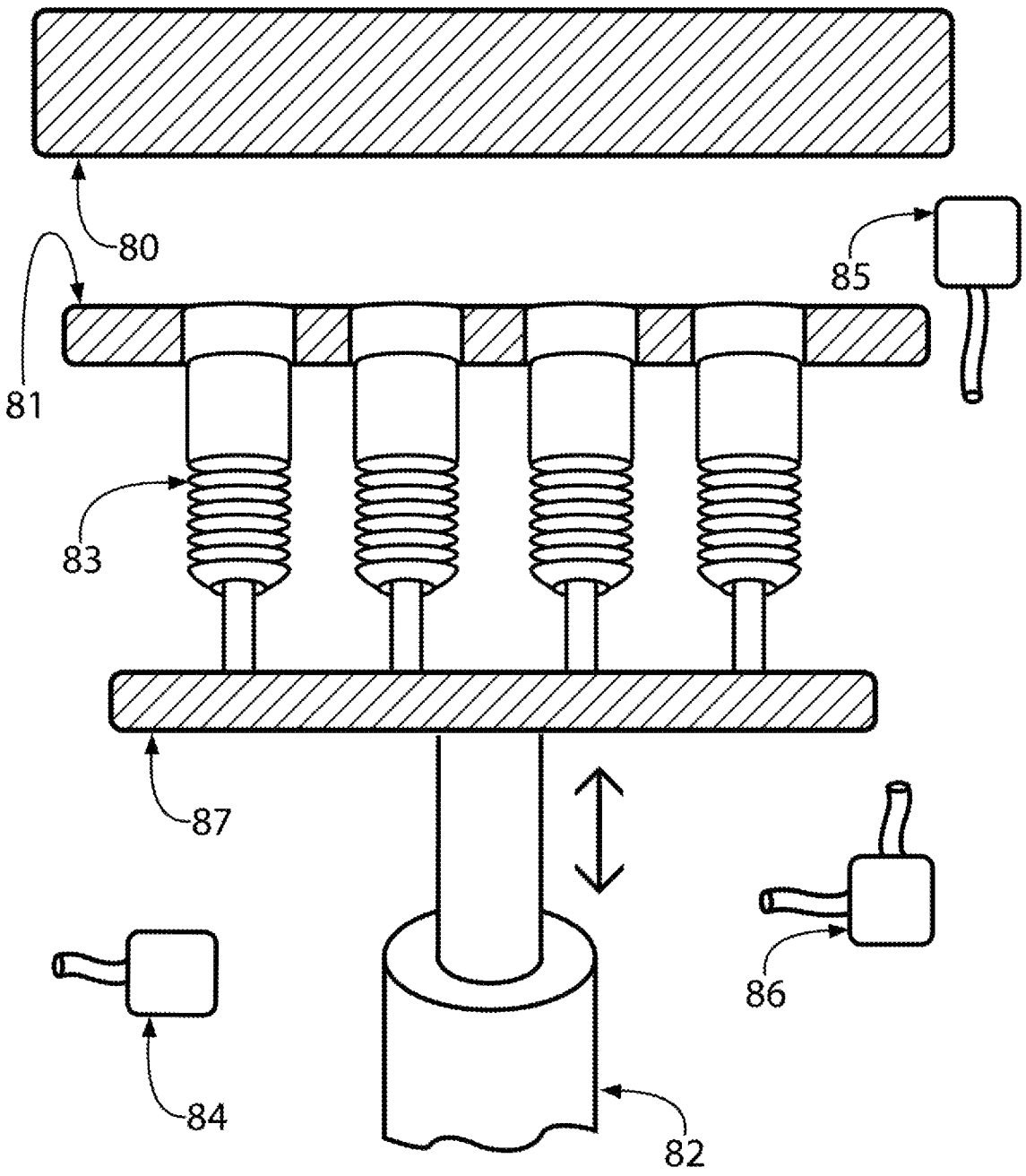
FIG. 8 is a partial cross-sectional and side isometric view of a controlled turbulence system in accordance with a fifth embodiment of the invention.

With reference to FIG. 8, in a fifth embodiment of the invention, an alternative method of providing pockets having adjustable pocket depths is illustrated. A surface 81 may contain pocket openings to receive billows 83 to form a field of pockets for a controlled turbulence system. It is appreciated that the surface 81 may contain other pattern features such as grooves (not illustrated) or non-billow-based pockets (not illustrated), and may include pockets/billows of differing dimensions (not illustrated) within the fields. The surface 81 and/or the billows 83 may employ a surface coating to be self-cleaning and may prevent the accumulation of matter. The surface 81 may be opposed by an optional surface 80. It is appreciated that this optional surface 80 may be fixed or moveable (not illustrated) if present. It also is appreciated that the optional surface 80 may contain a controlled turbulence system pattern (not illustrated). It is appreciated that a virtual surface, a fluid boundary, or fluid flows may functionally replace the optional surface.

The billows 83 may be connected to a billow plate 87. The billow plate 87 may be connected to a billow plate actuator 82. It is appreciated that each billow 83 may have its own actuator 82 (not illustrated) or that separate groups of billows may each have an actuator (not illustrated) thereby allowing the controlled turbulence system to have finer control or zone-based control. It also is appreciated that the billows 83 may be moved by manual means such as but not limited to adjustment screws or other manual positioning methods such as cams. The position of the actuator 82, billows 83, and/or billow plate 87 may be detected by position sensor 84. The flow, pressure, temperature, or other quantifiable measurements may be detected by a closed-loop feedback sensor 85. A control system 86 may adjust the actuator 82 in response to sensors 84, 85 and/or other optional additional control units (not illustrated).

Figure 9A:
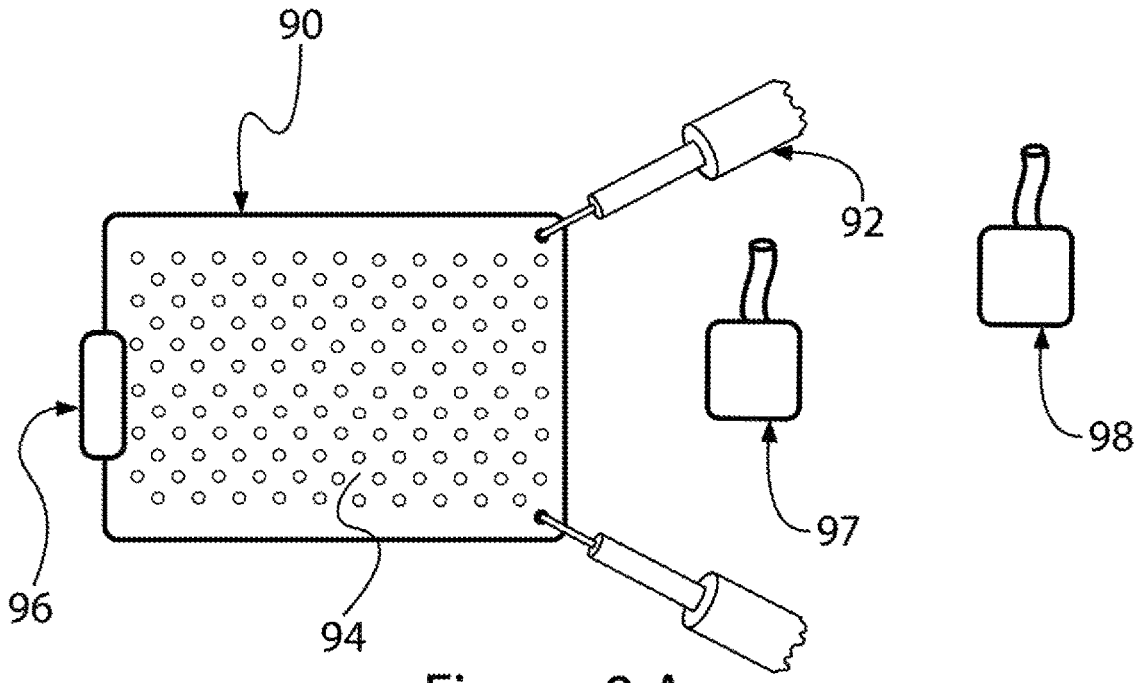
FIGS. 9A and 9B are plan views of a controlled turbulence system implemented in accordance with a sixth embodiment of the invention.
Figure 9B:
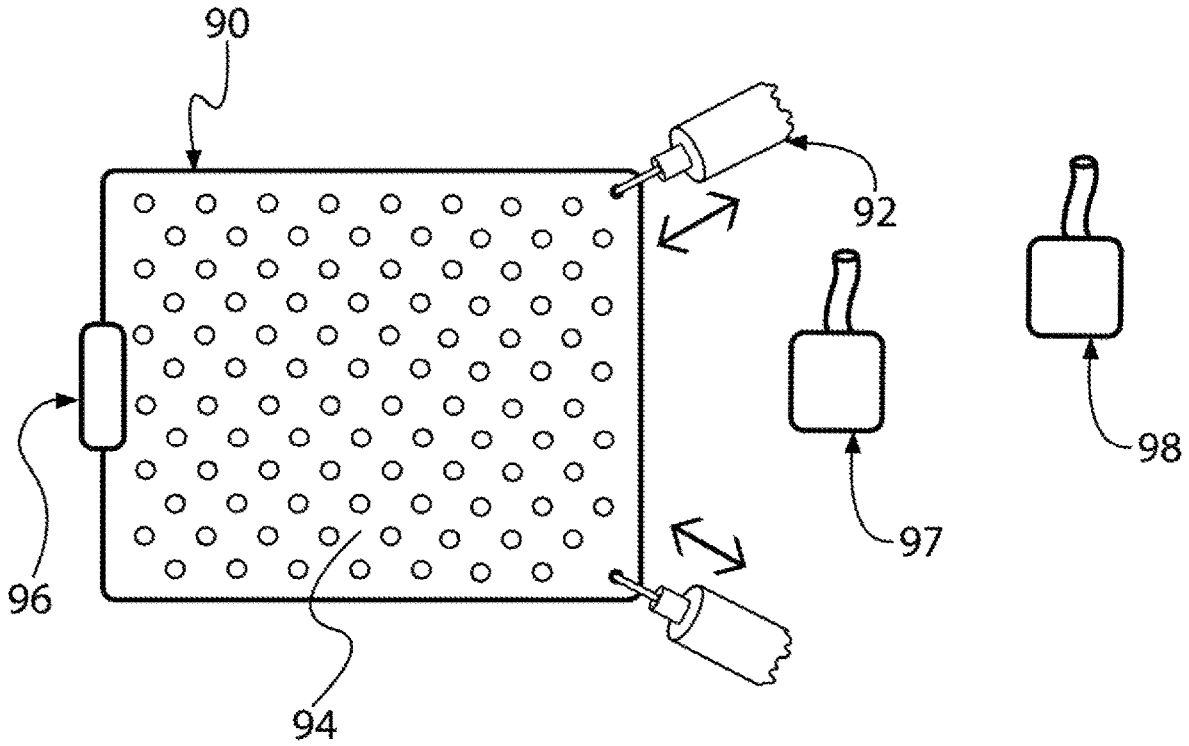

With reference to FIG. 9A, in a sixth embodiment of the invention, a method of adjusting the dimensions of the pockets in a field of pockets 94 is illustrated. A deformable surface 90 is attached to at least one anchor point 96 and at least one actuator 92. The deformable surface 90 contains a controlled turbulence system field of pockets 94. With reference to FIG. 9B, when the actuator 92 moves into a new position, it deforms the surface 90 so as to change the dimensions of the pockets in the field of pockets 94 and/or change the spacing between the pockets. This new controlled turbulence system pattern may now contain differently sized or shaped pockets that also may be spaced differently. Dependent upon the deformable material employed, the new controlled turbulence system pockets may also be more or less deep. The position of the actuator 92 and/or the deformation of the deformable surface 90 may be detected by the sensor 97. A control system 98 may adjust the actuator 92 in response to sensors 97 and/or other optional additional control units (not illustrated).

The controlled turbulence system embodiments may be employed on a single surface to induce aerodynamic effects on the surrounding fluid flow. The surrounding fluid flow may produce effects on any object that may be within or affected by the fluid flow. Some examples of such aerodynamic applications are illustrated in FIGS. 10-14.

With reference to FIG. 10, in an example embodiment of the invention, an aerodynamic system incorporating a controlled turbulence system for a projectile is illustrated. A barrel 62 contains an inside barrel surface 63. The inside barrel surface 63 has a controlled turbulence system 60 provided on it. The controlled turbulence system 60 may include a pattern of multiple sized and/or variably spaced pockets in a spiraling pattern similar to a rifling pattern. This pattern may induce unequal forces within the three-dimensional wave field. This inequality of forces may induce a spiraling motion by imparting at least one additional axis of motion to the fluid flow and any matter within or affected by the fluid flow. The pattern also may induce a self-centering and a drag-reducing effect, which may keep the projectile 61 from contacting the barrel inside surface as it passes through the controlled turbulence system. The drag-reducing effect when paired with the spiraling motion may allow the projectile to have a contactless induced spin that may increase the velocity at the barrel exit 64 and may induce a gyroscopic effect on the projectile.

FIG. 11 illustrates another example embodiment of the invention where a controlled turbulence system is used to decrease aerodynamic drag imparted to a vehicle 27 traveling through a tunnel 28. The inside surface of the tunnel 28 has a controlled turbulence system 26 applied to the side walls and roof of the tunnel. There may be an appreciable distance between the walls and the vehicle 27 as is common in current tunnel construction methods. This may create a drag-reducing effect that tends to create less resistance for the vehicle passing through the tunnel. This may also create a self-centering effect that may assist the vehicle in traversing the tunnel at higher rates of speed. This may further allow the vehicle to receive some forces that are directed towards the lower contact surface (e.g. road or tracks) to assist in keeping the vehicle firmly in contact with the lower contact surface.

FIG. 12 illustrates another embodiment of the invention involving an aerodynamic airfoil 135 with an adjustable controlled turbulence system 136 connected to a vehicle. The aerodynamic foil 135 may contain an integrated system 137. The integrated system 137 may contain coatings, self-cleaning apparatuses, sensors, actuators, and/or a control system. This may also allow the system to be self-cleaning in differing weather conditions and environments. The integrated system 137 may allow the controlled turbulence system 136 to adjust in real-time to the changing conditions that the vehicle may experience. This may allow the control of the drag-reducing effect and it may also allow the control of the magnitude and direction of the down forces generated on the aerodynamic airfoil 135. This may also allow the system to be self-diagnostic to assist in repair and servicing of the system. This may also allow communication and interfacing with other vehicle control systems and user interfaces to add further functions such as differing modes of operation. It is appreciated that this benefit may apply to other aerodynamic wing applications such as aircraft, watercraft, spacecraft, etc.

Figure 13:
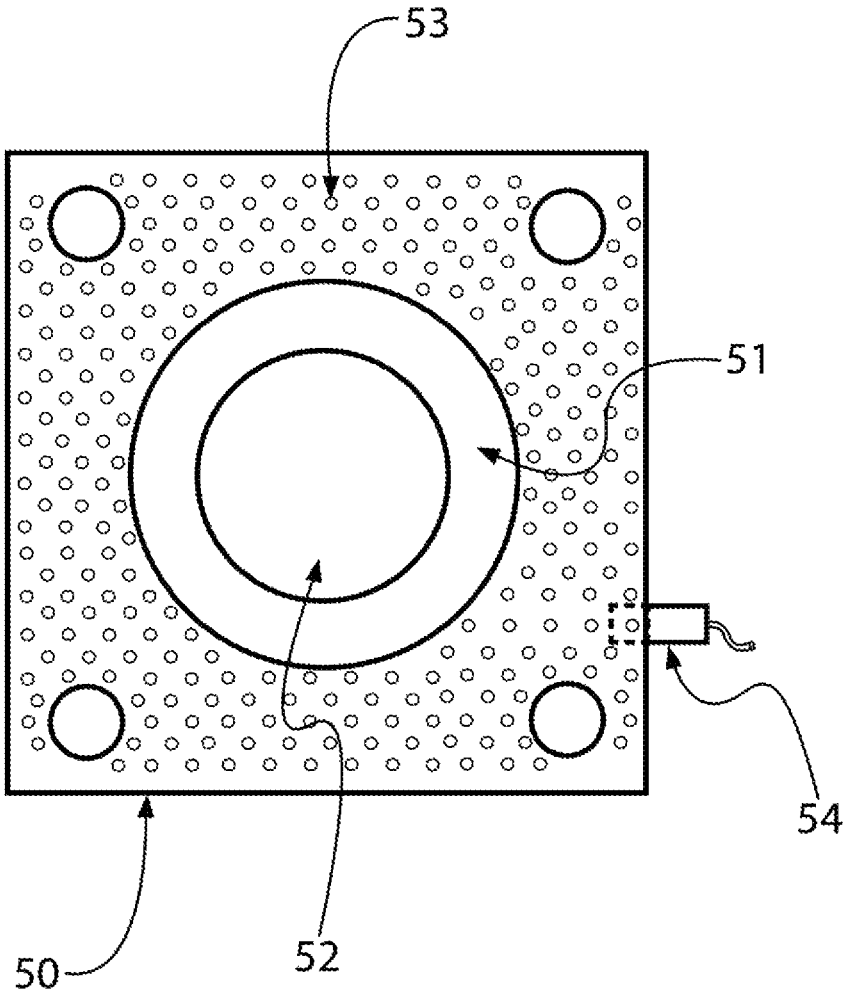
FIG. 13 is a plan view of a controlled turbulence system embodiment of the invention used to provide a failsafe seal.

In FIG. 13, another embodiment of the invention is illustrated in which a failsafe pressure seal is provided using a controlled turbulence system. A failsafe may be desirable in pressure seal applications requiring high-reliability and in applications that push the materials and components to the limit, such as drag racing and endurance-style racing. For example, a piston 52 and the other necessary components (not illustrated) for motor function may be contained within a block 50. A head gasket 51 may seal the block to the head (not illustrated). The gasket 51 may be constructed of metal, composite, fibrous, or other suitable materials. The gasket 51 may include multiple ribs/rings or a labyrinth pattern, to maintain the pressure seal. Due to thermal expansion, fastener failure, or numerous other failure mechanisms, the gasket 51 may leak while the engine is operating. The controlled turbulence system 53 may be employed in the small gap with a controlled small leakage. A sensor 54, gauge (not illustrated), or other suitable means (not illustrated) may be employed to detect the leak as it starts. This may allow the engine control system (not illustrated) or system operator (not illustrated) to compensate for and modify engine operating parameters to prevent a catastrophic failure, which may allow the prolonged use of the engine in this condition albeit with a possibly reduced operability. It is appreciated that this system may apply to other sealing applications in pressure vessels such as submarines, industrial processes, etc.

Figure 14:
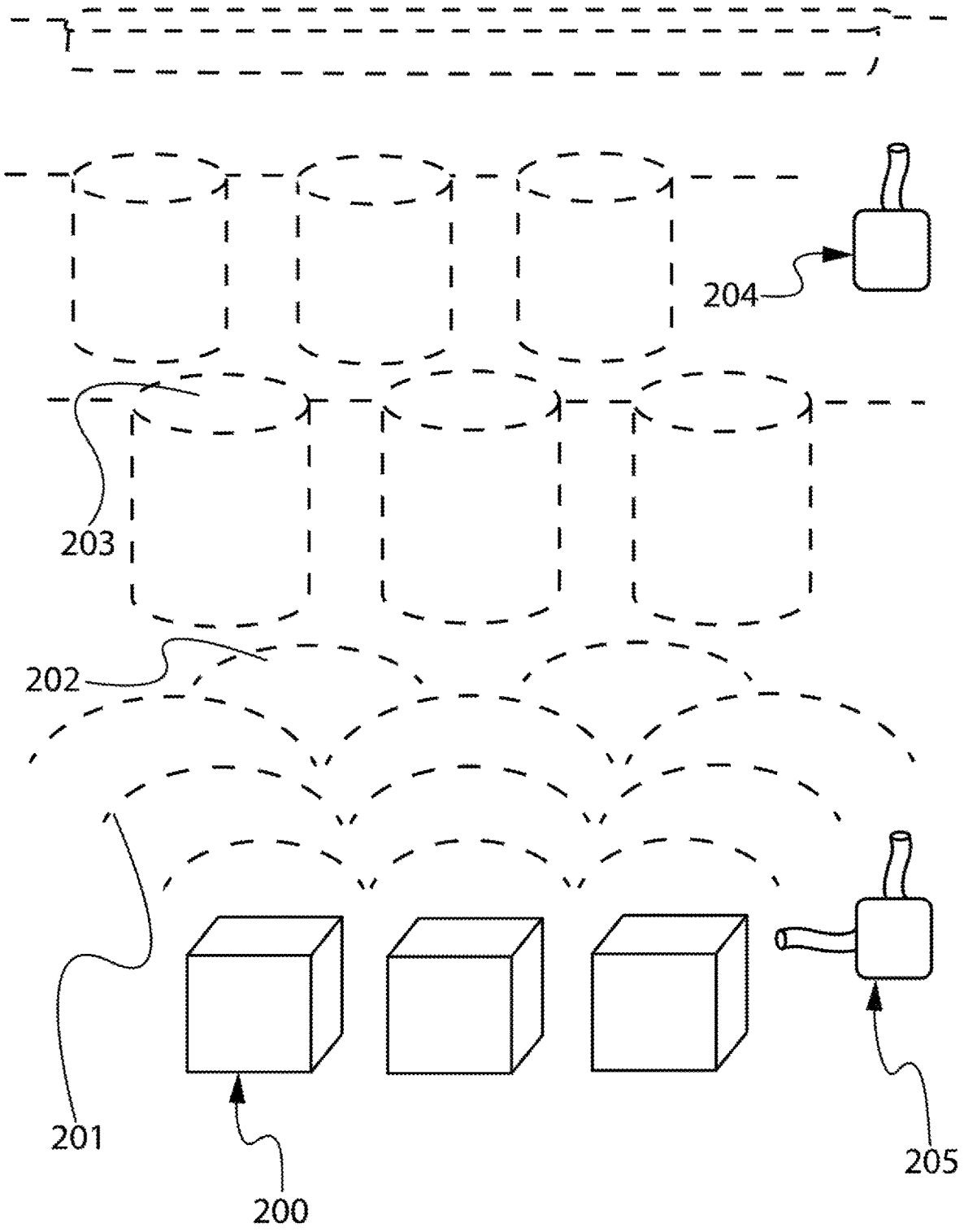
FIG. 14 is an illustration of a controlled turbulence system in accordance with a seventh embodiment of the invention.

With reference to FIG. 14, in a seventh embodiment of the invention a field of wave-based generators (e.g., transducers) 200 may be provided in lieu of one or more of the fields of pockets 21A and/or 22A to produce or induce individual waves 201. The generators 200 may be spaced apart from each other in a pattern that will produce composite waves 202 from the individual waves 201. The composite waves 202 may form a virtual surface 203 at a predetermined distance from the generators 200. The virtual surface 203 may be formed to function as a controlled turbulence system.

The wave based generators 200 may be provided, for example, by ultrasound transducers. The desired wave pattern to produce virtual surface 203 may be generated using a control unit 205 for the generators 200 coupled to one or more feedback sensor(s) 204 to make adjustments in real time. The control unit 205 may adjust (i.e., tune) the virtual surface 203 based on feedback from sensor(s) 204. The wave pattern may be adjusted to needs in real-time in response to other optional additional control units (not illustrated). This may include, but may not be limited to, adjusting the virtual feature locations and geometries, adjusting the shape or location of the virtual surface 203, adjusting the roughness of the virtual surface, and changing the number of virtual features in the virtual surface. This may allow a completely adjustable controlled turbulence system pattern for some applications. Such applications may involve low density gases with low density or small suspended particles.

It may also be important to consider the working fluid in which the virtual surface 203 may be created when selecting the frequency output of the wave based generators. Differences in fluid density, fluid temperature, fluid cavitation, and non-Newtonian fluid behavior may influence system function. The system may also be calibrated for different working fluids or different batches of working fluids, depending upon the characteristics of the working fluids. Such differences may require consideration in refined working fluids, such as petroleum products.

Figure 15:
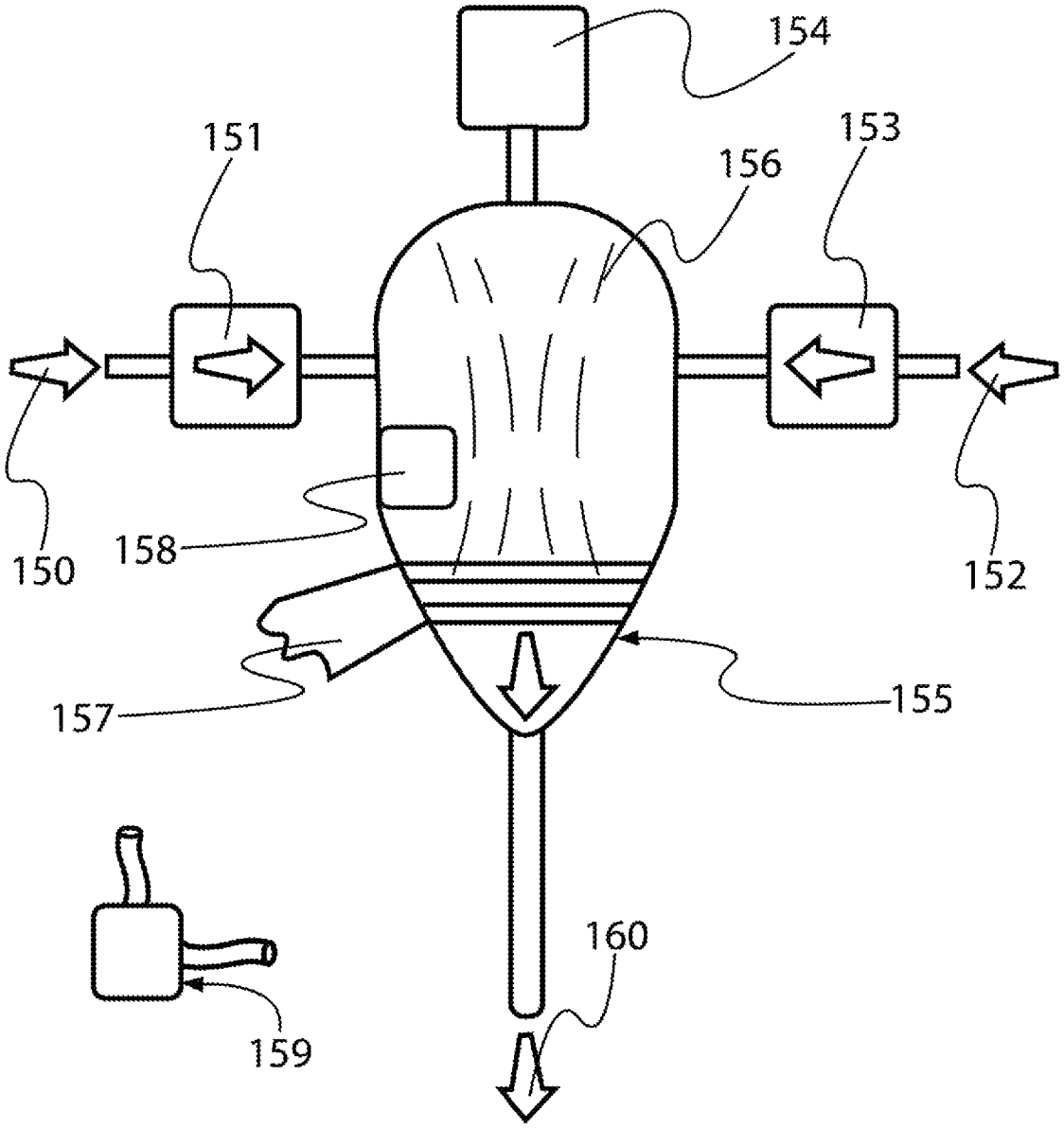
FIG. 15 is a diagram of an industrial mixer incorporating a controlled turbulence embodiment of the invention to provide fluid mixing.

In FIG. 15, an industrial mixing process embodiment of the invention is presented. Material 150 is provided to controlled turbulence system device 151. Likewise, material 152 is provided to controlled turbulence system device 153. It is appreciated that this system may process more than two materials, but only two materials have been presented for the sake of clarity of this functional illustration. The controlled turbulence system devices 151, 153 may provide an adjustable flow rate, a compressing action, an accelerating action, and/or pumping action to control the process. The two materials 150, 152 may be selectively injected into the process mixing vessel 155 under the influence of the controlled turbulence system devices 151, 153. Additional external energy, such as ultrasound, may be imparted to the system via an optional external energy unit 154. The materials 150, 152 in the mixing vessel 155 may mix, chemically change, and/or state/property change within the vessel. This process may induce pressure waves 156 within the vessel 155. These pressure waves 156 may increase localized areas of pressure by properly timing the introduction of material, and may generate a further mix, chemically change, and/or state/property change within the vessel 155. These pressure waves may be produced with a sufficient magnitude in a sufficiently small time to generate highly localized shockwaves. This may allow the process to generate significantly higher pressures internally without the need for further structural reinforcement of the pressure vessel, as the overall or average system pressure may never rise above the safe containment pressure of the vessel 155.

Additional energy may be added or removed from the FIG. 15 system by the application of heating/cooling or field application(s) via an optional energy exchange device 157. One or more sensors 158 may be operatively connected to the process mixing vessel to allow a control system 159 to monitor and adjust the process, including manipulation of the controlled turbulence system devices 151, 153 to control the flow of materials 150, 152 to the mixing vessel 155. This may aid in achieving a more consistent process output 160 without oscillations, unintended pulses, or other instabilities.

Figure 16:
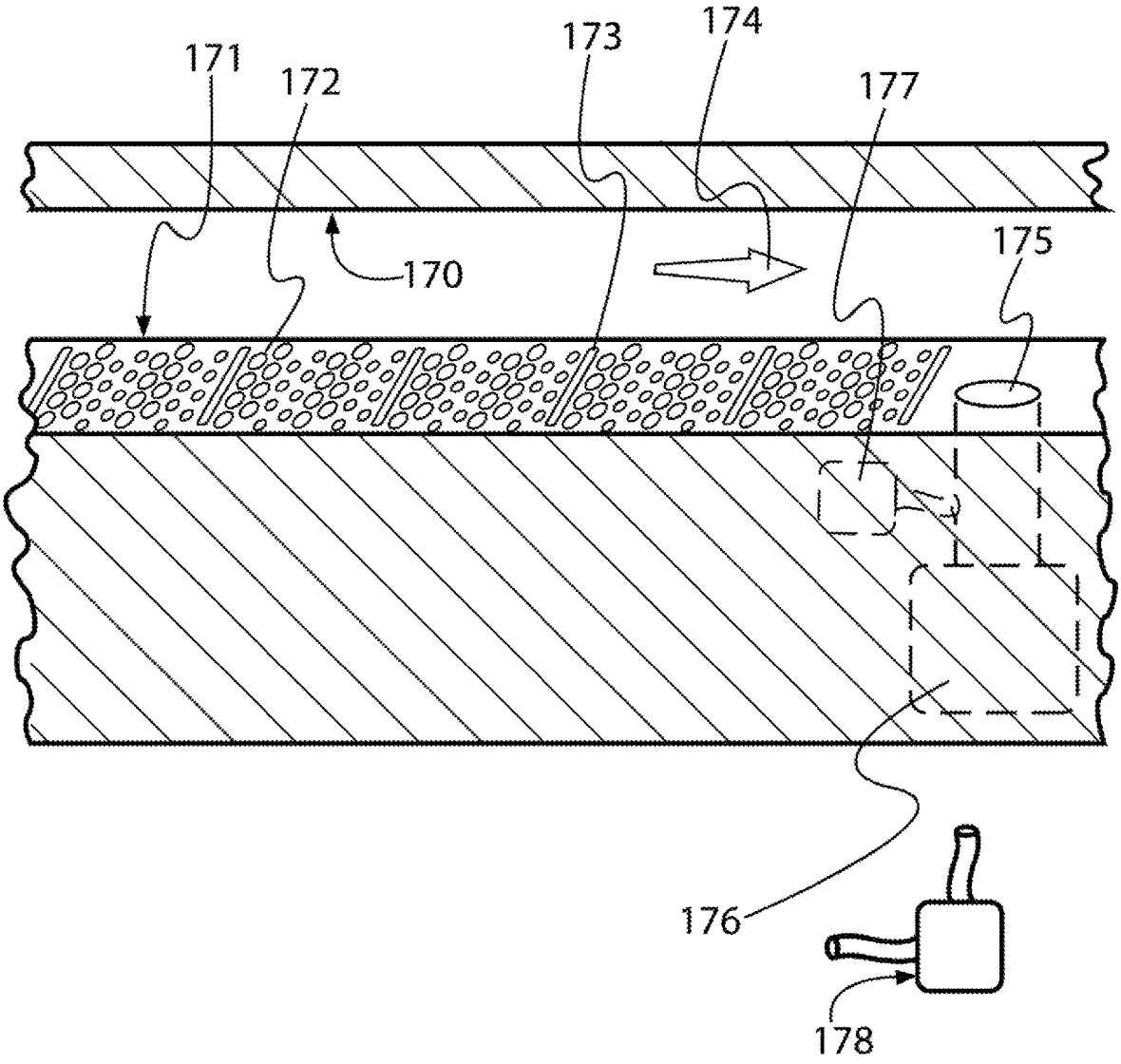
FIG. 16 is a partial cross-sectional view of a controlled turbulence system in accordance with an eighth embodiment of the invention.

With reference to FIG. 16, in an eighth embodiment of the invention a controlled turbulence system device embodiment is presented which may provide an adjustable flow rate, a compressing action, an accelerating action, and/or a pumping action to a process. A material may be introduced between an upper surface 170 and a block surface 171. A controlled turbulence system with multiple pockets 172 and optional grooves 173 may be arranged on the block surface 171 and/or the upper surface 170 (not illustrated). The pockets 172 may be of uniform sizes. However, it may be more functionally advantageous to employ the use of various sizes in the feature pattern. These sizes may be chosen to induce resonance in the pattern or respond to different resonant frequencies as previously discussed. The flow 174 may be adjusted by providing wave-based excitation energy from an adjustable energy source 176, such as an ultrasound transducer. The energy enters the flow through the energy input mouth 175. This energy may strengthen or weaken the turbulent effects produced by the pockets 172 and grooves 173 in the controlled turbulence system. One or more feedback sensors 177 may detect the flow rate, pressure, or other quantifiable attributes of the flow. A control system 178 may adjust the adjustable energy source based on sensors and/or other optional additional control units (not illustrated). This may allow the system to control the leak-rate of the system as a motionless on/off or proportional flow control valve.

Similarly, a pumping action may be induced by increasing the excitation of sections of the pattern while decreasing the excitation of other sections of the system. This excitation pattern action may be similar to positive displacement style pumping provided by a peristaltic pump. This may be achieved by using pockets 172 capable of inducing wave forms of various frequencies and exciting or depressing these areas of pockets by imparting different wave frequencies to the system. This difference of excitation may cause a variance of flow in different sections of the system.

The system may also be excited in differing sections of differing areas and at different orientations to the intended flow direction. Different pattern sections may be excited at different rates thereby moving material at an accelerated rate towards a slower moving excitation area. This may produce a compressing action within the pattern in a manner similar to that achieved using turbines or wave-rotor compressors. This excitation may also be progressively propagated through the system in a manner to generate acceleration of the material flow through the device. These pattern excitation schemes may generate actions similar to traditional valves, compressors, and/or pumps without the need for moving components.

The presented controlled turbulence system device may be used to provide a motionless control valve, compressor, and/or pump, which may function by controlled wave actions. It may have increased reliability in high value processes, as well as processes that require elaborate start-up and shut-down procedures. This may allow the system to have greater up time with longer intervals between planned maintenance and functional system validations. However, it is appreciated that previously presented configurations using moveable surfaces, adjustable patterns, deformable surfaces, and virtual surfaces may provide similar function albeit with shorter intervals between planned maintenance and functional system validations. It also is appreciated that the previously presented configurations using moveable surfaces may be employed in conjunction with the wave-based configuration presented here as a failsafe over-ride and/or protection during power failure, control system malfunction, and/or other undesired system states.

As will be understood by those skilled in the art, the invention may be embodied in other specific forms without departing from the spirit or essential characteristics thereof. The elements described above are provided as illustrative examples of one technique for implementing the invention. One skilled in the art will recognize that many other implementations are possible without departing from the present invention as recited in the claims. For example, the pockets and/or pattern of pockets need not be uniform and/or the lands need not be flat without departing from the intended scope of the invention. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed is:

1. A controlled turbulence system comprising:

a surface configured to be provided adjacent to a working fluid flowing substantially from an upstream location to a downstream location relative to the surface;

a first means configured to induce a first wave form in the working fluid along the surface adjacent to the working fluid;

a second means configured to induce a second wave form in the working fluid along the surface adjacent to the working fluid, wherein the first means is disposed upstream from the second means, wherein the first wave form and the second wave form have different frequencies, and wherein the first wave form and the second wave form cooperate in the working fluid to create a turbulence boundary layer in the working fluid along the surface.

2. The system of claim 1 wherein the first means comprises a plurality of laterally spaced pockets arranged in plurality of rows to form a field of pockets on or through the surface.

3. The system of claim 2 wherein the second means comprises a plurality of laterally spaced pockets arranged in a plurality of rows to form a field of pockets on or through the surface, and wherein the plurality of laterally spaced pockets comprising the second means have one or more dimensions that are different from one or more corresponding dimensions of the laterally spaced pockets comprising the first means.

4. The system of claim 2 wherein the second means comprises a transducer.

5. The system of claim 2 wherein the plurality of laterally spaced pockets comprising the first means have one or more dimensions, and wherein said system further comprises an apparatus configured to vary the one or more dimensions.

6. The system of claim 5 further comprising a closed-loop feedback device configured to assist in control of the apparatus configured to vary the one or more dimensions.

7. The system of claim 5 wherein the apparatus configured to vary the one or more dimensions includes pins or bellows disposed in the plurality of laterally spaced pockets, and wherein said pins or bellows are configured to move relative to the plurality of laterally spaced pockets.

8. The system of claim 5 wherein the apparatus configured to vary the one or more dimensions comprises means for deforming the surface.

9. The system of claim 1 further comprising an actuator for varying the position of the first means relative to the second means.

10. The system of claim 1 wherein the first means is a transducer.

11. The system of claim 1 wherein the first and second wave forms are three dimensional.

12. The system of claim 1 where the first means and the second means are transducers.

13. The controlled turbulence system of claim 1 wherein:

the first means is a first plurality of laterally spaced pockets arranged in a plurality of rows to form a first field of pockets on or through the surface, the second means is a second plurality of laterally spaced pockets arranged in a plurality of rows to form a second field of pockets on or through the surface, each of the pockets in the first field of pockets have a first dimension of the same magnitude, the first dimension magnitude of each of the pockets in the first field of pockets is configured to induce the first wave form in the working fluid along the surface adjacent to the working fluid, each of the pockets in the second field of pockets have the first dimension of the same magnitude, the first dimension magnitude of each of the pockets in the second field of pockets is configured to induce the second wave form in the working fluid along the surface adjacent to the working fluid, and the magnitude of the first dimension of each of the pockets in the first field of pockets is different than the magnitude of the first dimension of each of the pockets in the second field of pockets.

14. A controlled turbulence system comprising:

a surface;

a plurality of laterally spaced pockets arranged in plurality of rows to form a first field of pockets on or through the surface; and an apparatus configured to vary one or more dimensions of the plurality of laterally spaced pockets, wherein the apparatus and the plurality of laterally spaced pockets are configured to cooperate to create a turbulence boundary layer in a working fluid provided along the surface, wherein the working fluid flows substantially from an upstream location to a downstream location relative to the surface, and wherein the apparatus is disposed upstream from the plurality of laterally spaced pockets.

15. The system of claim 14 further comprising a plurality of laterally spaced pockets arranged in a plurality of rows to form a second field of pockets on or through the surface, and wherein the plurality of laterally spaced pockets comprising the first field of pockets have one or more dimensions that are different from one or more corresponding dimensions of the laterally spaced pockets comprising the second field of pockets.

16. The system of claim 14 further comprising a transducer.

17. The system of claim 14 further comprising a closed-loop feedback device configured to assist in control of the apparatus configured to vary the one or more dimensions.

18. The system of claim 14 wherein the apparatus configured to vary the one or more dimensions includes pins or bellows disposed in the plurality of laterally spaced pockets arranged in rows to form the first field of pockets, and wherein said pins or bellows are configured to move relative to the plurality of laterally spaced pockets arranged in rows to form the first field of pockets.

19. The system of claim 14 wherein the apparatus configured to vary the one or more dimensions comprises means for deforming the surface.

20. The system of claim 14 further comprising an equalizing groove formed on or through the surface in the field of pockets.

21. A method of creating a turbulence boundary layer in a working fluid along a surface adjacent to the working fluid, said working fluid flowing substantially from an upstream location to a downstream location relative to the surface, comprising the steps of:

inducing a first wave form in the working fluid along the surface adjacent to the working fluid at an upstream location;

inducing a second wave form in the working fluid along the surface adjacent to the working fluid at a downstream location, wherein the first wave form and the second wave form have different frequencies, and wherein the first wave form and the second wave form cooperate in the working fluid to create a turbulence boundary layer in the working fluid along the surface.

* * * * *